US007461499B2

(12) United States Patent
Liao

(10) Patent No.: US 7,461,499 B2
(45) Date of Patent: Dec. 9, 2008

(54) STRETCH WOVEN FABRICS

(75) Inventor: Tianyi Liao, Chadds Ford, PA (US)

(73) Assignee: INVISTA North America S.ar.l., Wilmington, DE (US)

( * ) Notice: Subject to any disclaimer, the term of this patent is extended or adjusted under 35 U.S.C. 154(b) by 0 days.

(21) Appl. No.: 11/941,279

(22) Filed: Nov. 16, 2007

(65) Prior Publication Data

US 2008/0070460 A1 Mar. 20, 2008

Related U.S. Application Data

(62) Division of application No. 11/055,939, filed on Feb. 11, 2005, now Pat. No. 7,310,932.

(51) Int. Cl.
*D02G 3/02* (2006.01)
*D02G 3/22* (2006.01)

(52) U.S. Cl. ..... 57/224; 57/226

(58) Field of Classification Search ..... 57/5, 57/210, 224, 227, 228; 428/364, 365, 373
See application file for complete search history.

(56) References Cited

U.S. PATENT DOCUMENTS

| | | | | |
|---|---|---|---|---|
| 3,671,379 | A | 6/1972 | Evans et al. | |
| 5,568,719 | A * | 10/1996 | Proctor | 57/225 |
| 5,735,110 | A * | 4/1998 | Kruger et al. | 57/224 |
| 5,874,372 | A | 2/1999 | Morishita et al. | |
| 5,922,433 | A | 7/1999 | Scherbel | |
| 5,958,548 | A * | 9/1999 | Negola et al. | 428/92 |
| 6,306,499 | B1 | 10/2001 | Ochi et al. | |
| 6,405,519 | B1 * | 6/2002 | Shaikh et al. | 57/210 |
| 6,548,429 | B2 | 4/2003 | Lintecum et al. | |
| 6,708,529 | B2 | 3/2004 | Yamazaki | |
| 6,782,923 | B2 | 8/2004 | Covelli | |
| 2003/0136099 | A1 * | 7/2003 | Hietpas et al. | 57/75 |
| 2003/0167581 | A1 | 9/2003 | Yamazaki et al. | |
| 2003/0187140 | A1 | 10/2003 | Lintecum et al. | |
| 2005/0227069 | A1 * | 10/2005 | Hietpas et al. | 428/364 |
| 2005/0233140 | A1 * | 10/2005 | Oh et al. | 428/364 |
| 2006/0024496 | A1 * | 2/2006 | Hietpas et al. | 428/359 |
| 2006/0040101 | A1 * | 2/2006 | Hietpas et al. | 428/364 |

FOREIGN PATENT DOCUMENTS

| | | |
|---|---|---|
| JP | 1997-195142 | 7/1997 |
| JP | 11172545 | 12/1997 |
| JP | 2002-115149 | 10/2000 |
| JP | 2002-155449 | 11/2000 |
| JP | 2003-155636 | 1/2001 |
| JP | 2003-073943 | 8/2001 |
| JP | 2003-073946 | 8/2001 |
| JP | 2003-073947 | 8/2001 |
| JP | 2003-073949 | 8/2001 |
| JP | 2003-073950 | 8/2001 |
| JP | 2003-073951 | 8/2001 |

(Continued)

*Primary Examiner*—Shaun R Hurley
(74) *Attorney, Agent, or Firm*—Christina W. Gearlof

(57) ABSTRACT

The invention provides a polyester bicomponent core spun yarn comprising a sheath of at least one hard fiber and having an English cotton count of from about 5 to about 60 and a core of bicomponent polyester filament. The invention further includes a fabric substantially free of grin-through of the bicomponent polyester filament.

10 Claims, 6 Drawing Sheets

FOREIGN PATENT DOCUMENTS

| | | |
|---|---|---|
| JP | 2003-119631 | 10/2001 |
| JP | 2003-119633 | 10/2001 |
| JP | 2003-119638 | 10/2001 |
| JP | 2003-119639 | 10/2001 |
| JP | 2002-266198 | 12/2001 |
| JP | 2003-221744 | 2/2002 |
| JP | 2003-286622 | 3/2002 |
| JP | 2003-301350 | 4/2002 |
| JP | 3365171 | 11/2002 |
| JP | 2003-020531 | 1/2003 |
| JP | 2003-221739 | 1/2003 |
| JP | 2003-073940 | 3/2003 |
| JP | 2003-073942 | 3/2003 |
| JP | 2003-113554 | 7/2003 |
| JP | 2003-221742 | 8/2003 |
| JP | 2003-221743 | 8/2003 |
| JP | 2003-247139 | 9/2003 |
| JP | 2004-044065 | 2/2004 |

* cited by examiner

STRETCH WOVEN FABRICS

CROSS-REFERENCE TO RELATED APPLICATIONS

This application is a divisional of U.S. patent application Ser. No. 11/055,939, filed on Feb. 11, 2005, which is incorporated herein by reference in its entirety.

FIELD OF THE INVENTION

This invention relates to polyester bicomponent filament core spun yarn, fabric comprising such yarn, and the garments made from such fabric. More specifically, this invention relates to core spun yarn comprising poly(trimethylene terephthalate) bicomponent filament, and the stretch wovens comprising such yarn. This invention also relates to a process for making such woven fabrics.

BACKGROUND OF THE INVENTION

Polyester bicomponent filaments have been disclosed, for example in U.S. Pat. No. 3,671,379. Woven stretch fabrics comprising polyester bicomponent filaments have been disclosed, for example in U.S. Pat. Nos. 5,922,433 and 6,782,923. The fabrics disclosed in these references are comprised of bare bicomponent filaments and have strong synthetic appearance and hand due to the exposure of the bicomponent filaments on the fabric surface.

Core spun yarns containing polyester bicomponent filaments and fabrics comprising them have been disclosed. For example, Japanese patent applications JP2003-221742A and JP2003-221743A disclosed single and double wrapped bicomponent stretch yarn in which polyester bicomponent filaments are twisted and covered by cotton spun yarns. Japanese patent applications JP2003-073940A and JP2003-073942A disclose polyester bicomponent filament core spun yarns in which the bicomponent filaments are covered with animal fur, for example wool. However, the bicomponent filaments are exposed on the surface of the core spun yarns and on the fabrics comprising them.

Such exposure, or "grin-through," is undesirable in apparel applications because the bicomponent filaments can be seen and felt. This results in the fabric having a glittery look and a hot, synthetic hand. In order to reduce grin-through, it is necessary to dye the fabric in two separate dyeing steps, which is a high cost and tedious process. Furthermore, it is difficult to match the color of the sheath staple fiber to that of the bicomponent filament core. Core spun yarns comprising polyester bicomponent filaments which do not have exposure of the bicomponent filaments are still sought. Fabrics comprising such yarns, which have improved appearance and hand, are also sought.

SUMMARY OF THE INVENTION

The present invention provides a polyester bicomponent core spun yarn comprising a sheath of at least one hard fiber and having an English cotton count of from about 5 to about 60 and a core of bicomponent filament comprising poly(trimethylene terephthalate) and at least one polymer selected from the group consisting of poly(ethylene terephthalate), poly(trimethylene terephthalate), and poly(tetramethylene terephthalate) or a combination of such members, wherein the yarn denier is from about 10 to about 100 and the bicomponent filament is from about 5 weight percent to about 30 weight percent, based on total weight of yarn. The term "English Cotton Count" means the number of hanks, i.e., 840 yds, that weigh 1 lb.

The present invention also provides a polyester bicomponent core spun yarn comprising a sheath of at least one hard fiber and having an English cotton count of from about 5 to about 60 and a core of polyester bicomponent filament comprising poly(trimethylene terephthalate) and at least one polymer selected from the group consisting of poly(ethylene terephthalate), poly(trimethylene terephthalate), and poly (tetramethylene terephthalate) or a combination of such members, wherein the yarn denier is from about 101 to about 600 and the bicomponent filament is from about 5 weight percent to about 35 weight percent, based on total weight of yarn.

The present invention further provides a woven stretch fabric having warp and weft yarns and comprising polyester bicomponent core spun yarn, wherein the core spun yarn comprises a sheath of at least one hard staple fiber and a core of polyester bicomponent filament comprising poly(trimethylene terephthalate) and at least one polymer selected from the group consisting of poly(ethylene terephthalate), poly (trimethylene terephthalate), and poly(tetramethylene terephthalate) or a combination of such members, having an after heat-set crimp contraction value of from about 10% to about 80%, and wherein the fabric is substantially free of bicomponent filament grin-through.

The present invention additionally provides a process for making a stretch woven fabric comprising poly(trimethylene terephthalate) bicomponent core spun yarn.

The present invention also provides a garment comprising the woven stretch fabric of the invention.

BRIEF DESCRIPTION OF THE FIGURES

FIG. 3 is an image of five fabric standards used to rate fabric grin-through.

DETAILED DESCRIPTION OF THE INVENTION

Figure 1A:
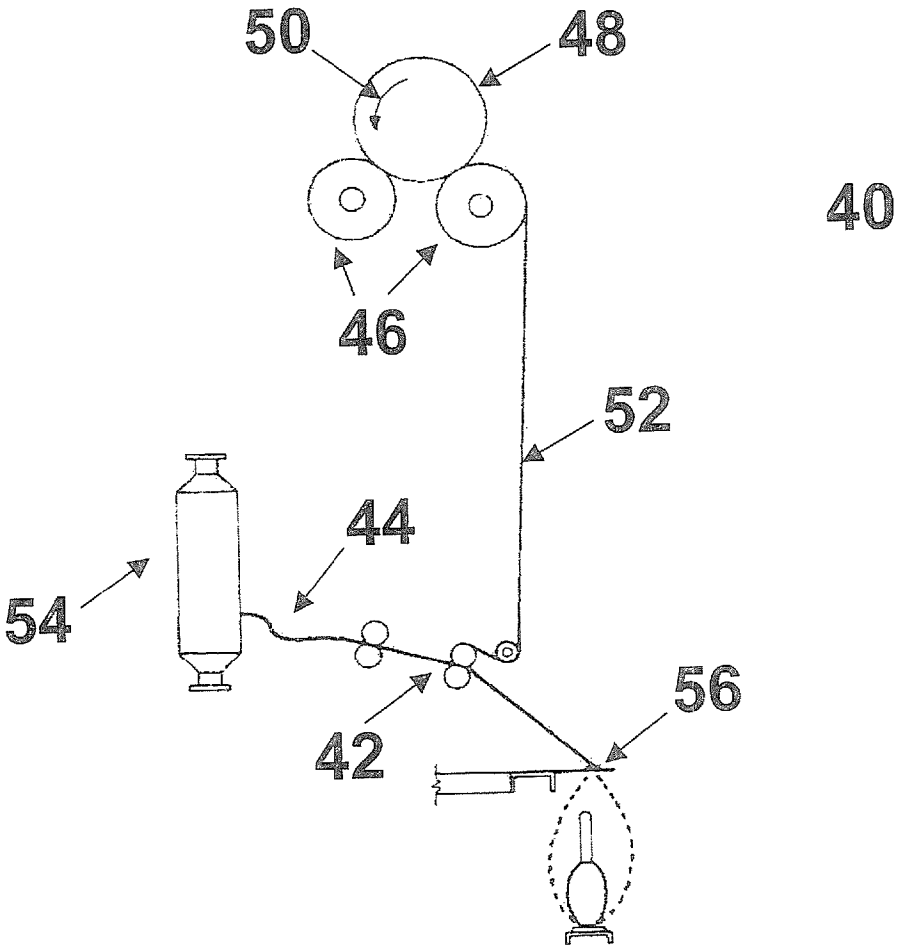
FIG. 1A is a schematic representation of one embodiment of a core spinning apparatus.

This invention relates to bicomponent filament core spun yarns which comprise poly(trimethylene terephthalate) bicomponent filament. The invention also relates to stretch woven fabrics comprising such core spun yarns. The fabrics are substantially free of bicomponent filament "grin-through" and also have a desirable combination of stretch, a soft hand, excellent comfort when worn, dimensional stability, and a natural fiber look and feel. The invention also relates to a process for making such stretch woven fabric, as well as garments comprising the fabric of the invention.

As used herein, "bicomponent filament" means a continuous filament in which two polymers of the same general class are intimately adhered to each other along the length of the fiber, so that the fiber cross-section is for example a side-by-side, eccentric sheath-core, or other suitable cross-section from which useful crimp can be developed.

As used herein, the term "side-by-side" means that the two components of the bicomponent fiber are immediately adjacent to one another and that no more than a minor portion of either component is within a concave portion of the other component. "Eccentric sheath-core" means that one of the two components completely surrounds the other component but that the two components are not coaxial.

The polyester bicomponent filament of the core spun yarn, the fabric, the garments, and the process of the invention comprises poly(trimethylene terephthalate) and at least one polymer selected from the group consisting of poly(ethylene terephthalate), poly(trimethylene terephthalate), and poly (tetramethylene terephthalate) or a combination of such members, in a weight ratio of from about 30:70 to about 70:30 and has an after heat-set crimp contraction value of at least about 10%, for example at least about 35% and at most about 80%. The bicomponent filament is present in the fabric from about 5 weight percent (wt %) to about 35 wt %, based on the total weight of the fabric. The polymers may be, for example, poly(ethylene terephthalate) and poly(trimethylene terephthalate), poly(trimethylene terephthalate) and poly(tetramethylene terephthalate), or poly(trimethylene terephthalate) and poly(trimethylene) terephthalate, for example of different intrinsic viscosities, although different combinations are also possible. Alternatively, the compositions can be similar, for example a poly(trimethylene terephthalate) homopolyester and a poly(trimethylene terephthalate) copolyester, optionally also of different viscosities. Other polyester bicomponent combinations are also possible, such as poly (ethylene terephthalate) and poly(tetramethylene terephthalate), or a combination of poly(ethylene terephthalate) and poly(ethylene terephthalate), for example of different intrinsic viscosities, or a poly(ethylene terephthalate) homopolyester and a poly(ethylene terephthalate) copolyester. As used herein, the notation "//" is used to separate the two polymers used in making a bicomponent filament. Thus, for example, "poly(ethylene terephthalate)//poly(trimethylene terephthalate)" indicates a bicomponent filament comprising poly(ethylene terephthalate) and poly(trimethylene terephthalate).

One or both of the polyesters comprising the fiber of the invention can be copolyesters, and "poly(ethylene terephthalate)," "poly(tetramethylene terephthalate)", and "poly(trimethylene terephthalate)" include such copolyesters within their meanings. For example, a copoly(ethylene terephthalate) can be used in which the comonomer used to make the copolyester is selected from the group consisting of linear, cyclic, and branched aliphatic dicarboxylic acids (and their diesters) having 4-12 carbon atoms (for example butanedioic acid, pentanedioic acid, hexanedioic acid, dodecanedioic acid, and 1,4-cyclo-hexanedicarboxylic acid); aromatic dicarboxylic acids (and their diesters) other than terephthalic acid and having 8-12 carbon atoms (for example isophthalic acid and 2,6-naphthalenedicarboxylic acid); linear, cyclic, and branched aliphatic diols having 3-8 carbon atoms (for example 1,3-propane diol, 1,2-propanediol, 1,4-butanediol, 3-methyl-1,5-pentanediol, 2,2-dimethyl-1,3-propanediol, 2-methyl-1,3-propanediol, and 1,4-cyclohexanediol); and aliphatic and araliphatic ether glycols having 4-10 carbon atoms (for example, hydroquinone bis(2-hydroxyethyl)ether, or a poly(ethyleneether) glycol having a molecular weight below about 460, including diethyleneether glycol). The comonomer can be present to the extent that it does not compromise the benefits of the invention, for example at levels of about 0.5-15 mole percent based on total polymer ingredients. Isophthalic acid, pentanedioic acid, hexanedioic acid, 1,3-propane diol, and 1,4-butanediol are exemplary comonomers.

The copolyester(s) can also be made with minor amounts of other comonomers, provided such comonomers do not have an adverse effect on the physical properties of the fiber. Such other comonomers include 5-sodium-sulfoisophthalate, the sodium salt of 3-(2-sulfoethyl) hexanedioic acid, and dialkyl esters thereof, which can be incorporated at about 0.2-5 mole percent based on total polyester. For improved acid dyeability, the (co)polyester(s) can also be mixed with polymeric secondary amine additives, for example poly(6,6'-imino-bishexamethylene terephthalamide) and copolyamides thereof with hexamethylenediamine, preferably phosphoric acid and phosphorous acid salts thereof. Small amounts, for example about 1 to 6 milliequivalents per kg of polymer, of tri- or tetra-functional comonomers, for example trimellitic acid (including precursors thereto) or pentaerythritol, can be incorporated for viscosity control.

The polyester bicomponent filament can also comprise conventional additives such as antistats, antioxidants, antimicrobials, flameproofing agents, lubricants, dyestuffs, light stabilizers, and delustrants such as titanium dioxide.

A "covered" bicomponent filament is one surrounded by, twisted with, or intermingled with at least one "hard" yarn. "Hard" yarn refers to relatively inelastic yarn, such as polyester, cotton, nylon, rayon, or wool. The covered yarn that comprises bicomponent filaments and hard yarns is also termed a "composite yarn" in the text of this specification. The hard yarn sheath covers the synthetic luster, glare, and bright appearance of the polyester bicomponent filament. The hard yarn covering also serves to protect the bicomponent filaments from abrasion during weaving processes. Such abrasion can result in breaks in the bicomponent fiber with consequential process interruptions and undesired fabric non-uniformities. Further, the covering helps to stabilize the bicomponent filament's elastic behavior, so that the composite yarn elongation can be more uniformly controlled during weaving processes than would be possible with bare bicomponent filaments.

There are multiple types of composite yarns, including (a) single wrapping of the bicomponent filaments with a hard yarn; (b) double wrapping of the bicomponent filaments with a hard yarn; (c) continuously covering (i.e., core spinning) a bicomponent filament with staple fibers, followed by twisting during winding; (d) intermingling and entangling bicomponent filaments and hard yarns with an air jet; and (e) twisting bicomponent filaments and hard yarns together. One example of a composite yarn is a "core spun yarn" (CSY), which consists of a separable core surrounded by a spun fiber sheath. In a cotton/bicomponent core spun yarn, a bicomponent filament comprises the core and is covered by staple cotton fibers. Bicomponent core spun yarns are produced by introducing a bicomponent filament to the front drafting roller of a spinning frame where it is covered by staple fibers.

The polyester bicomponent core spun yarn of the invention comprises polyester bicomponent fiber having linear density in the range from about 10 denier to about 900 denier, for example from about 20 denier to about 600 denier. The linear density of the hard yarn can range from about 5 English cotton count (Ne) to about 60 English cotton count, for example from 6 English cotton count to about 40 English cotton count.

One embodiment of a representative core spinning apparatus 40 is shown in FIG. 1A. During core spinning processing, a bicomponent polyester filament is combined with a hard yarn to form a composite core spun yarn. The bicomponent filament from tube 48 is unwound in the direction of arrow 50 by the action of positively-driven feed rollers 46. The feed rollers 46 serve as a cradle for the tube 48 and deliver the bicomponent filament of yarn 52 at a pre-determined speed.

The hard fiber or yarn 44 is unwound from tube 54 to meet the bicomponent filament 52 at the set of front rollers 42. The combined bicomponent filament 52 and hard fiber 44 are core spun together at spinning device 56.

The bicomponent filament 52 is stretched (drafted) before it enters the front rollers 42. The bicomponent filament is stretched through the speed difference between feed rollers 46 and front rollers 42. The delivery speed of the front rollers 42 is greater than the speed of the feed rollers 46. Adjusting the speed of the feed rollers 46 gives the desired draft or stretch ratio.

This stretch ratio is normally 1.01× times to 1.25× times (1.01× to 1.25×) compared to the unstretched fiber. Too low a stretch ratio will result in low quality yarns having grin-through and an uncentered bicomponent filament. Too high a stretch ratio will result in breakage of the bicomponent filament and core void.

Figure 1B:
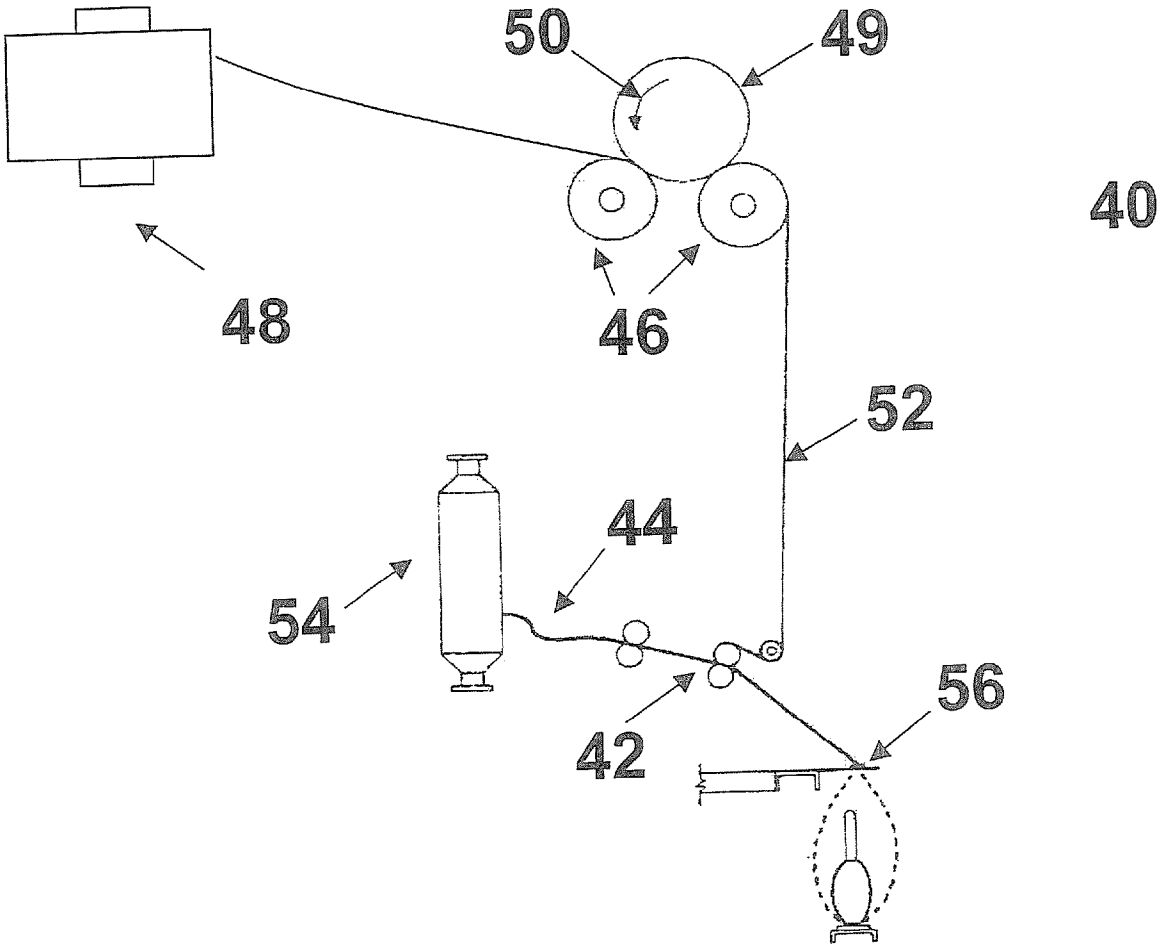
FIG. 1B is a schematic representation of another embodiment of a core spinning apparatus.

Another embodiment of a representative core spinning apparatus 40 is shown in FIG. 1B. The bicomponent filament from tube 48 is unwound in the direction of arrow 50 by the action of positively-driven feed rollers 46. The weighted roll 49 serves to maintain stable contact between the bicomponent filament and feed rollers 46 in order to deliver the bicomponent filament of yarn 52 at a pre-determined speed. Other elements of FIG. 1B are as described for FIG. 1A.

"Grin-through" is a term used to describe the exposure, in a fabric, of bare bicomponent filaments. The term can also be applied to composite yarn, in which case grin-through refers to the exposure of the core bicomponent filament through the covered yarn. Grin-through can manifest itself visibly as an undesirable glitter or to the touch as a synthetic feeling or hand. Low grin-through on the face side of the fabric is preferable to low grin-through on the back side of the fabric.

Grin-through becomes more apparent after the yarns and fabrics are dyed. In most cases the sheath staple fiber, for example cotton or wool, is different from the core polyester bicomponent filament. The dye material and dye processing conditions are different for cotton or wool as compared to polyester. Normally, cotton is dyed through reactive, vat, or direct dyeing at a temperature below 100° C., while polyester is dyed with a disperse dye at a temperature above 100° C. When a core spun yarn with a polyester bicomponent core is dyed under conditions optimal for the sheath staple fiber but not optimal for the polyester bicomponent core, the polyester bicomponent filaments cannot pick up the dyestuff and maintain the desired color. As a result, grin-through often becomes more apparent after the dyeing step.

Conventionally, the way to reduce grin-through is to dye both the sheath fiber and the core polyester bicomponent filament in two consecutive dyeing processes using two types of dyestuff, where each dyeing process is optimized for either the core or the sheath fiber. When dyeing polyester filament, high temperature (from about 110° C. to about 130° C.) is required. Such high temperature is undesirable, however, because it could reduce the elastic power of the bicomponent filament. A multi-step dyeing process also incurs added expense due to the additional processing steps required.

For many end uses, core spun yarn containing an elastomeric core needs to be dyed before weaving. Package yarn dyeing is the simplest and most economical method for processing core spun yarns. Conventional core spun yarns comprising cotton and elastomeric fibers suffer from disadvantages incurred during yarn package dye processing. Conventionally, the elastomeric core yarn retracts at the hot water temperatures used in package dyeing. In addition, the composite yarn on the package will compress and become very tight, thereby impeding the flow of dyestuffs into the interior of the package yarn. This can often result in yarn with different color shades and stretch levels, depending on the yarn's diametric position within the dyed package. To reduce this problem, small packages are sometimes used for dyeing core spun composite yarns. However, small-package dyeing is relatively expensive because of extra packaging and handling requirements.

The polyester bicomponent core spun yarn of the invention can be successfully package dyed without the requirement of small-package dyeing and without obtaining different color shades and stretch levels within the package. There is no excessive retractive power within the package to create high package densities which could lead to uneven dyeing. The yarn of the invention enables cone-dyeing of elastic yarn without the need for special cone design and special handling. The polyester bicomponent filament core spun yarn can maintain its stretch characteristic during the yarn dyeing process.

In the polyester bicomponent core spun yarn of the invention, polyester bicomponent filament of about 10 to 100 denier or less does not grin-through the yarn or fabric surface when the bicomponent filament comprises less than 30 wt % of the core spun yarn, based on total weight of the yarn. For polyester bicomponent filament of 101 to about 900 denier, the bicomponent filament core spun yarns and fabrics comprising them exhibit no grin-through when the bicomponent filament comprises less than 35 wt % of the core spun yarn, based on total weight of the yarn. It is also found that the bicomponent filament remains in the center of the core spun yarn after the heat relaxation step.

Figure 2A:
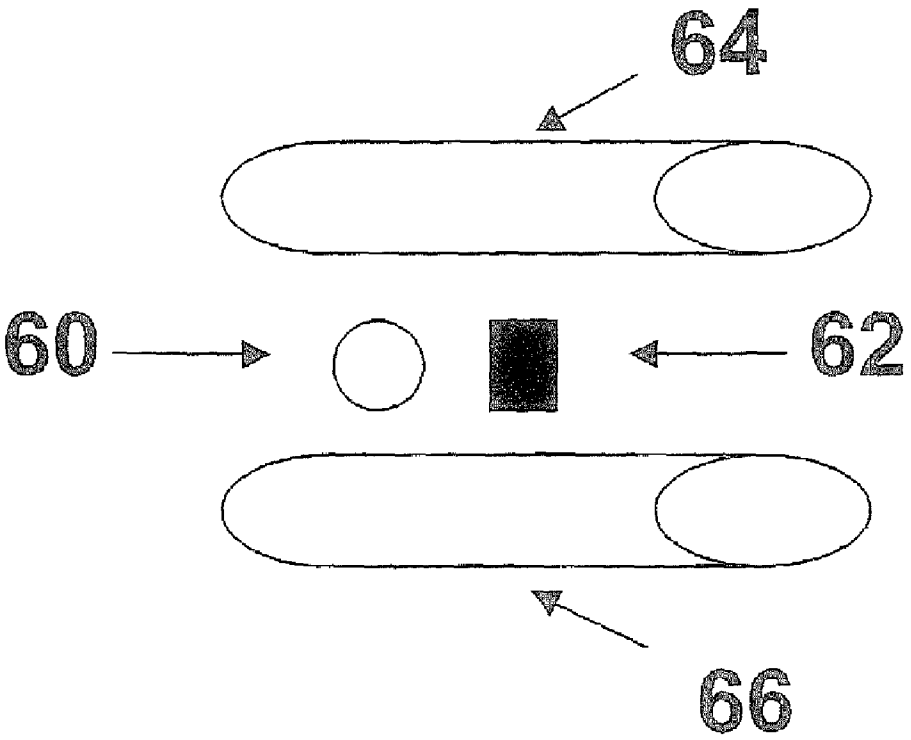
FIG. 2A is a schematic representation of the relative positions of the bicomponent filament and the roving ribbon during core spinning of a core spun yarn having "Z" twist.

During the core spinning process, grin-through may be caused by improper alignment of the core and roving. Proper alignment of the core and the roving can effectively control the grin-through. For single end roving feed, the best results are obtained when the bicomponent filament is positioned at the edge of the roving and opposite to the direction of twist. A schematic representation of the relative positions of the bicomponent filament and the roving ribbon in the front draft rolls during core spinning of a core spun yarn having "Z" twist is shown in FIG. 2A. In this case, the bicomponent filament 60 should be directed to the left edge of the roving ribbon 62 as it leaves the front draft rolls 68, which are comprised of a front top roll 64 and a front bottom roll 66. The result is a shift in the center of twist for the aggregate structure, which favors covering the bicomponent filament.

Figure 2B:
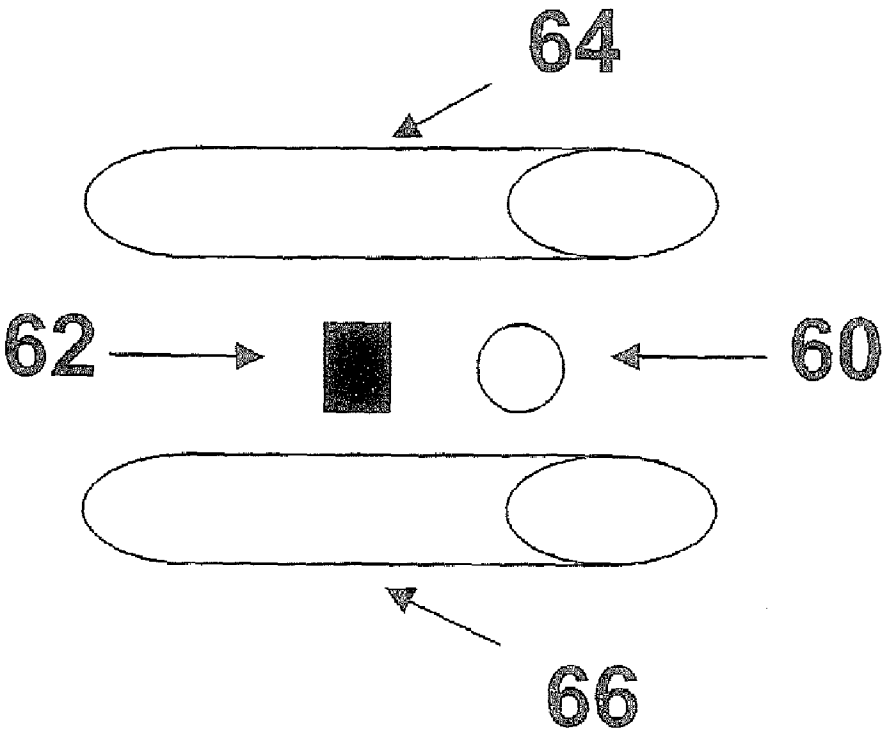
FIG. 2B is a schematic representation of the relative positions of the bicomponent filament and the roving ribbon during core spinning of a core spun yarn having "S" twist.

For core spun yarns with "S" twist, the bicomponent filament 60 should be directed to the right edge of the roving ribbon 62 as it leaves the front top roll 64 and the front bottom roll 66 of the front draft rolls 68, as illustrated in FIG. 2B.

Figure 2C:
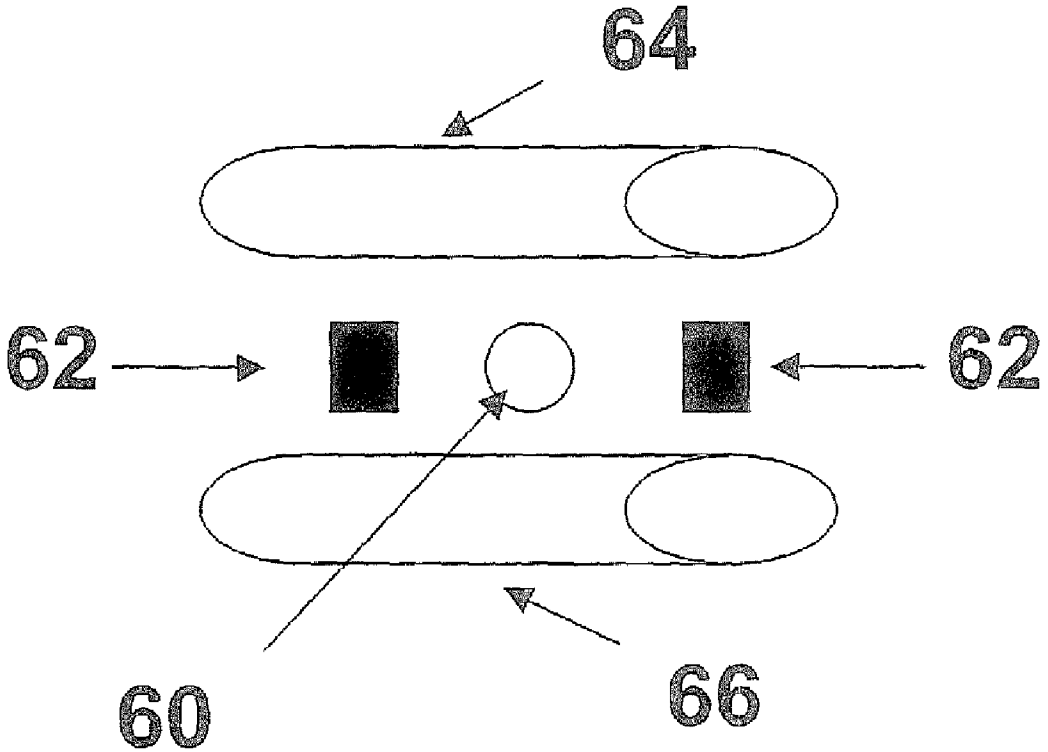
FIG. 2C is a schematic representation of the relative positions of the bicomponent filament and the roving ribbons during core spinning of a core spun yarn with double fed roving.

FIG. 2C illustrates proper alignment of the bicomponent filament core and the roving ribbons for double fed roving, such as siro-spun for worsted fabrics. In this case the bicomponent filament 60 should be aligned between the two roving ribbon ends 62 as it leaves the front top roll 64 and the front bottom roll 66 of the front draft rolls in order for the bicomponent filament to be properly covered.

Another common yarn defect which can occur in the core spinning process and contributes to grin-through is "sheath void." Sheath void is characterized by lengths of bicomponent yarn which lack covering by the sheath staple fiber. Sheath void can occur when the roving breaks as it is fed from the front drafting roller while the bicomponent fiber continues to run. At the point of break, the "pneumafil" unit or the scavenger rollers pick up the fiber until the bicomponent filament and the roving again combine themselves to continue core spinning. This results in a "sheath void" even though the end appears to be spinning continuously.

Sheath void defects can be prevented by optimizing spinning conditions, especially the alignment of bicomponent filament and roving at the front roller. Uneven roving or high spinning draft and speed can cause a high frequency of "sheath voids."

Stretch woven fabric comprising the polyester bicomponent core spun yarn of the invention can be made by the following process. Polyester bicomponent filament comprising poly(trimethylene terephthalate) and having an after heat-set crimp contraction value from about 10% to about 80% is combined with a staple roving yarn, such as cotton, wool, linen, polyester, nylon, and rayon or a combination of these, to make a polyester bicomponent filament core spun yarn. The bicomponent filament is drafted from about 1.01× to about 1.25× of its original length during formation of the polyester bicomponent filament core spun yarn. The core spun yarn is then woven with at least one staple spun yarn or filament to form a fabric, which is then dyed and finished by piece dyeing or continuous dyeing methods.

The polyester bicomponent filament core spun yarn may be used in either warp or weft direction to produce warp or weft stretch fabric. The available fabric stretch (elongation) in the direction of the core spun yarn can be at least about 10% and no more than about 35%. This range of available fabric stretch provides sufficient comfort to the wearer while avoiding poor fabric appearance and too much fabric growth. The polyester bicomponent filament core spun yarn may also be used in both the warp and weft direction of a fabric to obtain a bi-stretch fabric, one which has stretch in both the warp and the weft directions. In this case, the available fabric stretch can be at least about 10% and no more than about 35% in each direction.

If polyester bicomponent filament core spun yarn is used in one direction, for example in the weft direction, a filament of yarn having stretch-and-recovery properties (for example spandex, polyester bicomponent fibers, and the like) may be used in the other direction, for example in the warp direction. In this case, the fabric can have warp stretch as well as weft-stretch characteristics.

When polyester bicomponent filament core spun yarn is used in one direction, for example in the weft direction, there are no particular restrictions on the fibers in the other direction of the fabric, provided the benefits of the present invention are not compromised. Spun staple fibers of cotton, polycaprolactam, poly(hexamethylene adipamide), poly(ethylene terephthalate), poly(trimethylene terephthalate), poly(tetramethylene terephthalate), wool, linen, and blends thereof can be used, as can filaments of polycaprolactam, poly(hexamethylene adipamide), poly(ethylene terephthalate), poly (trimethylene terephthalate), poly(tetramethylene terephthalate), spandex, and blends thereof. Similarly, when bicomponent core spun yarn is used in the warp direction, there are no particular restrictions on the weft fibers of the fabric, provided the benefits of the present invention are not compromised. Many types of spun staple fibers and filaments, as exemplified for warp yarns, may be used in the weft direction.

The woven fabric of the invention can be a plain woven, twill, weft rib, or satin fabric. Examples of twill fabric include 2/1, 3/1, 2/2, 1/2, 1/3, herringbone, and pointed twills. Examples of weft rib fabrics include 2/3 and 2/2 weft ribs. The fabric of the invention is suitable for use in various garments for which stretch is desirable, such as pants, jeans, shirts, and sportswear.

In order to obtain an available fabric stretch level similar to that of previously-known stretch fabric made from spandex core spun yarn or bare bicomponent filament, the fabric of the invention needs to be designed with a more open construction. When the yarn cover factor of the greige fabric in the stretch direction is engineered to be about 5% to about 10% lower than conventional stretch fabrics, fabric with greater than 10% stretch can be achieved. Therefore, in comparison to standard commercial rigid fabrics for similar end use, the fabric of the invention should have about 15% to about 20% lower fabric cover factor. In conventional stretch fabrics comprising spandex core spun yarn or bare bicomponent filament, the fabric is required to have around 10% to about 15% more openness in the direction of stretch than typical rigid fabric.

The openness of the fabric in the warp and weft direction can be characterized as Fabric Cover Factor (FCF). This determines the degree of yarn occupation or cover in fabric. Fabric Cover Factor quantifies the actual number of yarns that are side by side as a percentage of the maximum number of the yarns that can lie side by side. It is calculated as follows:

$$\text{Fabric Cover Factor (\%)} = \frac{\text{Actual ends/inch} \times 100}{\text{Maximum Ends/inch}}$$

The maximum ends of yarn are the number of yarns that can lie down side-by-side in one inch in the jammed structure with no yarns overlapping. Fabric cover factor is mainly determined by yarn diameter or count, expressed as:

$$\text{Maximum Ends/inch} = CCF \times (\text{Yarn count, } Ne)^{0.5}$$

CCF refers to compact cover factor. For 100% cotton ring spun yarn, CCF was determined to be 28). Yarn count (Ne) represents the yarn size. It is equal to the number of 840 yard skeins required to weight one pound. As yarn count values increase, the fineness of the yarn increases. (For reference, see Weaver's Handbook of Textile Calculations, Dan McCreaght, Institute of Textile Technology, Charlottesville, Va., 1999).

Good results can be obtained when the fabric cover factors in the warp and weft directions on the loom are selected as in the following table. For different weaving structures, the cover factors have different optimum ranges.

TABLE 1

| | Fabric Cover Factors (%) | |
|---|---|---|
| Fabric Type | Warp Direction | Weft Direction |
| 3/1 twill | 55-85 | 32-55 |
| 2/1 twill | 55-82 | 30-52 |
| 1/1 plain | 45-65 | 28-52 |
| 5/1 satin | 60-85 | 24-55 |

Loom types that can be used to make the woven fabrics of the invention include airjet looms, shuttle looms, waterjet looms, rapier looms, and gripper (projectile) looms.

Piece dyeing or continuous dyeing processes can be used for dyeing and finishing the fabrics of the invention.

For conventional stretch fabric made from spandex covered core spun yarn or bare bicomponent filament, heat setting is used to "set" the elastic fibers. For conventional stretch fabric, heatsetting is necessary in order to prevent retraction of the elastic fibers and the resultant compression of the fabric. Without heatsetting, the fabric can have high wash shrinkage or too high a stretch level, which makes it difficult for the fabric to return to its original size during wear. Without heatsetting, excessive shrinkage can occur during the finishing process, which results in crease marks on the fabric surface appearing during processing and household washing. These crease marks make it difficult to flatten the fabric. Heatsetting is typically done at about 380° F. (193° C.) to about 390° F. (199° C.) for about 30 to about 50 seconds.

The stretch fabric of the invention does not require heatsetting. The fabric meets the end use specification and maintains low shrinkage (less than 5%) even without heatsetting. By eliminating the high-temperature heat set previously required, the manufacturing process for the fabric of the invention may reduce heat damage to fibers like cotton and thus improves the hand, or feel, of the finished fabric. As a further benefit, heat sensitive hard yarns such as poly(trimethylene terephthalate), silk, wool, and cotton can be used to make stretch fabrics of the invention, thus increasing the possibilities for different and improved products. In addition, eliminating process steps previously required shortens manufacturing time and improves productivity.

The fabrics of the invention have a very good, cottony hand. The fabrics feel soft, smooth, and are comfortable to wear. No bicomponent filament exposure occurs on the fabric surface; bicomponent fiber can not be seen or felt. The fabrics feel more natural and have better drape than conventional elastic wovens, which are usually too stretchy and have a synthetic, hot hand.

Test Methods

Crimp Contraction Value

The after heat-set crimp contraction value of the polyester bicomponent filament used in the Examples was measured as follows. Each filament sample was formed into a skein of 5000+/−5 total denier (5550 dtex) with a skein reel at a tension of about 0.1 gpd (0.09 dN/tex). The skein was conditioned at 70° F. (+/−2° F.) (21°+/−1° C.) and 65% (+/−2%) relative humidity for a minimum of 16 hours. The skein was hung substantially vertically from a stand, a 1.5 mg/den (1.35 mg/dtex) weight (e.g. 7.5 grams for a 5550 dtex skein) was hung on the bottom of the skein, the weighted skein was allowed to come to an equilibrium length, and the length of the skein was measured to within 1 mm and recorded as "$C_b$". The 1.35 mg/dtex weight was left on the skein for the duration of the test. Next, a 500 gram weight (100 mg/d; 90 mg/dtex) was hung from the bottom of the skein, and the length of the skein was measured to within 1 mm and recorded as "$L_b$", Crimp is contraction value (percent) (before heat-setting, as described below for this test), "$CC_b$% was calculated according to the formula:

$$CC_b=100\times(4-C_b)/L_b$$

The 500 g weight was removed, and the skein was then hung on a rack and heat-set, with the 1.35 mg/dtex weight still in place, in an oven for 5 minutes at about 250° F. (121° C.), after which the rack and skein were removed from the oven and conditioned as above for two hours. This step is designed to simulate commercial dry heat-setting, which is one way to develop the final crimp in the bicomponent fiber. The length of the skein was measured as above, and its length was recorded as "$C_a$". The 500-gram weight was again hung from the skein, and the skein length was measured as above and recorded as "$L_a$". The after heat-set crimp contraction value (percent), "$CC_a$", was calculated according to the formula:

$$CC_a=100\times(L_a-C_a)/L_a$$

Yarn Potential Stretch

Elastic core spun yarns were formed into a skein with 5-cycles with a standard sized skein reel at a tension of about 0.1 grams per denier. The length of one cycle yarn is 1365 mm. The skein yarn was boiled off at 100° C. in water for 10 minutes under free tension. The skeins were dried in air and were conditioned for 16 hours at 20° C. (+/−2° C.) and at 65% relative humidity (+/−2%).

The skein was folded over four times to form a thickness which is 16 times the thickness of the original skein of yarn. The folded skein was mounted on an Instron tensile testing machine. The skein was extended to a load of 1000 grams force and relaxed for three cycles. During the third cycle, the length of skein under 0.04 Kg load force is recorded as $L_1$, the length of skein under 1 Kg force is recorded as $L_0$. Yarn Potential Stretch (YPS) is calculated as a percentage according to the following equation:

$$YPS=[(L_0-L_1)/L_0]*100$$

Woven Fabric Elongation (Available Fabric Stretch)

Fabrics are evaluated for % elongation under a specified load (i.e., force) in the fabric stretch direction(s), which is the direction of the composite yarns (i.e., weft, warp, or weft and warp). Three samples of dimensions 60 cm×6.5 cm are cut from the fabric. The long dimension (60 cm) corresponds to the stretch direction. The samples are partially unraveled to reduce the sample widths to 5.0 cm. The samples are then conditioned for at least 16 hours at 20° C. (+/−2° C.) and 65% relative humidity, (+/−2%).

A first benchmark is made across the width of each sample, at 6.5 cm from a sample end. A second benchmark is made across the sample width at 50.0 cm from the first benchmark. The excess fabric from the second benchmark to the other end of the sample is used to form and stitch a loop into which a metal pin can be inserted. A notch is then cut into the loop so that weights can be attached to the metal pin.

The sample non-loop end is clamped and the fabric sample is hung vertically. A 30 Newton (N) weight (6.75 LB) is attached to the metal pin through the hanging fabric loop, so that the fabric sample is stretched by the weight. The sample is "exercised" by allowing it to be stretched by the weight for three seconds, and then manually relieving the force by lifting the weight. This is done three times. The weight is then allowed to hang freely, thus stretching the fabric sample. The distance in millimeters between the two benchmarks is measured while the fabric is under load, and this distance is designated ML. The original distance between benchmarks (i.e., unstretched distance) is designated GL. The % fabric elongation for each individual sample is calculated as follows:

$$\%\ \text{Elongation}(E\%)=((ML-GL)/GL)\times 100.$$

The three elongation results are averaged for the final result.

Woven Fabric Growth (Unrecovered Stretch)

After stretching, a fabric with no growth would recover exactly to its original length before stretching. Typically, however, stretch fabrics will not fully recover and will be slightly longer after extended stretching. This slight increase in length is termed "growth."

The above fabric elongation test must be completed before the growth test. Only the stretch direction of the fabric is tested. For two-way stretch fabric both directions are tested. Three samples, each 55.0 cm×6.0 cm, are cut from the fabric. These are different samples from those used in the elongation test. The 55.0 cm direction should correspond to the stretch direction. The samples are partially unraveled to reduce the sample widths to 5.0 cm. The samples are conditioned at temperature and humidity as in the above elongation test. Two benchmarks exactly 50 cm apart are drawn across the width of the samples.

The known elongation percent (E %) from the elongation test is used to calculate a length of the samples' at 80% of this known elongation. This is calculated as $$E(\text{length}) \text{ at } 80\% = (E\%/100) \times 0.80 \times L,$$

where L is the original length between the benchmarks (i.e., 50.0 cm). Both ends of a sample are clamped and the sample is stretched until the length between benchmarks equals L+E (length) as calculated above. This stretch is maintained for 30 minutes, after which time the stretching force is released and the sample is allowed to hang freely and relax. After 60 minutes the % growth is measured as $$\%\ \text{Growth} = (L_2 \times 100)/L,$$

where $L_2$ is the increase in length between the sample benchmarks after relaxation and L is the original length between benchmarks. This % growth will be measured for each sample and the results averaged to determine the growth number.

Woven Fabric Shrinkage

Fabric shrinkage is measured after laundering. The fabric is first conditioned at temperature and humidity as in the elongation and growth tests. Two samples (60 cm×60 cm) are then cut from the fabric. The samples should be taken at least 15 cm away from the selvage. A box of four sides of 40 cm×40 cm is marked on the fabric samples.

The samples are laundered in a washing machine with the samples and a loading fabric. The total washing machine load should be 2 kg of air-dried material, and not more than half the wash should consist of test samples. The laundry is gently washed at a water temperature of 40° C. and spun. A detergent amount of 1 g/l to 3 g/l is used, depending on water hardness. The samples are laid on a flat surface until dry, and then they are conditioned for 16 hours at 20° C. (+/−2° C.) and 65% relative humidity (+/−2%).

Fabric sample shrinkage is then measured in the warp and weft directions by measuring the distances between markings. The shrinkage after laundering, C %, is calculated as $$C\% = ((L_1 - L_2)/L_1) \times 100,$$

where $L_1$ is the original distance between markings (40 cm) and $L_2$ is the distance after drying. The results are averaged for the samples and reported for both weft and warp directions. Positive shrinkage numbers reflect expansion, which is possible in some cases because of the hard yarn behavior.

Fabric Weight

Woven Fabric samples are die-punched with a 10 cm diameter die. Each cut-out woven fabric sample is weighed in grams. The "fabric weight" is then calculated as grams/square meters (g/m$^2$).

Fabric Grin-Through Rating:

Fabric grin-through is determined by evaluation of samples on a five point rating scale. A fabric sample is compared to five fabric standards, all in a fully relaxed (unstretched) condition, under only normal overhead fluorescent lighting. Three trained observers rate each test specimen independently, and the results are averaged.

A series of T-400™ core spun yarns having different extents of bicomponent filament exposure on the fabric surface were produced. The yarns were then used to form five 1/1 plain weave fabric standards with 80s/2 cotton as the warp and 40s+50 D T-400™ core spun yarn as the weft. The fabric standards were dyed navy blue.

Figure 3:
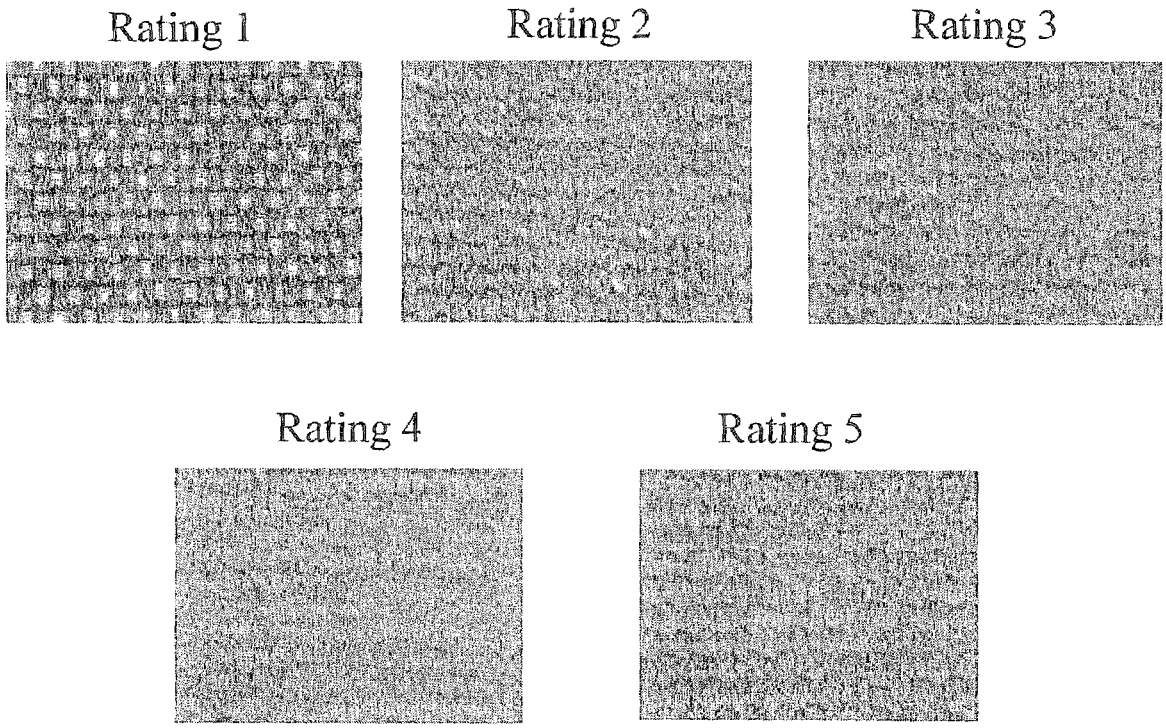

FIG. 3 is an image of the five fabric standards used to rate fabric grin-through. Grin-through ratings for the fabric standards were as follows. A rating of 1 corresponds to complete exposure of bicomponent filament on the fabric surface. A rating of 2 corresponds to severe exposure of bicomponent filament on the fabric surface. A rating of 3 corresponds to partial exposure of bicomponent filament on the fabric surface. A rating of 4 corresponds to slight exposure of bicomponent filament on the fabric surface. A rating of 5 corresponds to no exposure of bicomponent filament on the fabric surface. A fabric which is substantially free of bicomponent filament grin-through is one which has a rating of 4 or 5 by this grin-through rating method.

In the Tables, "Comp. Ex" means Comparison Example.

EXAMPLES

The following examples demonstrate the present invention and its capability for use in manufacturing a variety of woven stretch fabrics. The invention is capable of other and different embodiments, and its several details are capable of modifications in various apparent respects, without departing from the scope and spirit of the present invention. Accordingly, the examples are to be regarded as illustrative in nature and not as restrictive.

The polyester bicomponent fiber used in the following yarn examples is Type 400™ brand poly(ethylene terephthalate) H/poly(trimethylene terephthalate) bicomponent fiber, commercially available from Invista S. à r. l. Type 400™ brand poly(ethylene terephthalate)//poly(trimethylene terephthalate)bicomponent fiber is also referred to herein as T-400™ brand polyester bicomponent fiber, or simply as T-400™. T-400™ can have an after heat-set crimp contraction value of from about 10% to about 80%, for example of from about 35% to about 80%.

Table 2 lists the materials and process conditions that were used to manufacture the core spun yarns used in the fabric Examples. In the Table, "T-400™ draft" refers to the draft of the T-40™ filament (or the spandex filament in Comparison Example 1B) imposed by the core spinning machine (also known as machine draft); "cotton count" refers to the linear density of the cotton portion of the spun yarn as measured by the English cotton count system. The yarns were made using the indicated draft in a core spinning process as described previously.

TABLE 2

Data for Core Spun Yarn (CSY) Examples.

| Yarn Example # | T-400 ™ Linear Density Dtex (Denier)[1] | Filament Number in Core of CSY | T-400 ™ Draft [2] | Cotton Count | Total Yarn Count | wt % T-400 ™ in Yarn [3] | YPS value % |
|---|---|---|---|---|---|---|---|
| 1A | 83 dtex (75D) | 34 | 1.10X | 32'S | 22.7'S | 29.1 | 26.66 |
| 2A | 55 dtex (50D) | 34 | 1.08X | 38'S | 28.7'S | 24.87 | 29.94 |
| 3A | 83 dtex (75D) | 34 | 1.10X | 27'S | 20'S | 28.59 | 38.90 |
| 4A | 83 dtex (75D) | 34 | 1.10X | 27'S | 20'S | 28.59 | 38.90 |
| 5A | 165 dtex (150D) | 68 | 1.10X | 20'S | 12.5'S | 37.64 | 46.19 |
| 6A | 165 dtex (150D) | 68 | 1.10X | 20'S | 12.5'S | 37.64 | 46.19 |
| Comp. Ex. 1A | 44 dtex (40D) | 4 | 3.5X | 43.5'S | 40'S | 8.6 | 61.1 |
| Comp. Ex. 2A | 83 dtex (75D) | 34 | — | — | 75D | 100 | 43.55 |
| Comp. Ex. 3A | 83 dtex (75D) | 34 | 1.10X | 54.7'S | 29.4'S | 46.26 | 50.71 |

Notes:
[1] Denier is abbreviated as D.
[2] For Comp. Ex. 1B, the draft is for spandex.
[3] For Comp. Ex. 1B, the wt % value is for spandex in yarn.

Stretch fabrics were subsequently made using the T-400™ cotton core spun yarns (or the Comparison yarns) of the yarn Examples as the weft yarns. For each fabric Example, the T-400™ cotton core spun yarn of the similarly numbered yarn Example was used as the weft yarn. For example, the yarn of Example 1A was used as the weft yarn for the fabric of Example 1B. Similarly, the bare T-400™ filament of Comparison Example 2A was used as the weft yarn for the fabric of Example 2B.

For each of the fabric examples, 100% cotton or blended staple spun yarns were used as warp yarns. The warp yarns were sized before beaming. The sizing was performed on a Suziki single end sizing machine. PVA sizing agent was used. The temperature in the sizing bath was about 107° F. (42° C.) and the air temperature in the drying area was about 190° F. (88° C.). Sizing speed was about 300 yards/minute (276 meters per minute). The residence time of the yarn in the drying area was about 5 minutes.

Table 3 summarizes the yarns used, the weave patterns, and the quality characteristics of the fabrics of the Examples. Unless otherwise noted, the fabrics were woven on a Donier air-jet loom. Loom speed was 500 picks/minute.

Each greige fabric was finished by first passing it under low tension through hot water three times at 160° F. (71° C.), 180° F. (82° C.), and 202° F. (94° C.) for 20 seconds. Next, each woven fabric was pre-scoured with 3.0 weight % Lubit®64 (Sybron Inc.) at 49° C. for 10 minutes. Afterwards it was de-sized with 6.0 weight % Synthazyme® (Dooley Chemicals. LLC Inc.) and 2.0 weight % Merpol® LFH (E.I. duPont de Nemours and Company) for 30 minutes at 71° C. and then scoured with 3.0 weight % Lubit® 64, 0.5 weight % Merpol® LFH and 0.5 weight % trisodium phosphate at 82° C. for 30 minutes. The fabric was then bleached with 3.0 weight % Lubit® 64, 15.0 weight % of 35% hydrogen peroxide, and 3.0 weight % sodium silicate at pH 9.5 for 60 minutes at 82° C. Fabric bleaching was followed by jet-dyeing with a black or navy direct dye at 93° C. for 30 minutes. No heat setting was performed on these fabrics.

Example 1B

This Example demonstrates a stretch shirting fabric comprising 75D T-400®core spun yarn. The warp yarn was 80/2 Ne count of ring spun cotton yarn; the weft yarn was 32 Ne cotton with 75D T-400® core spun yarn in which the T-400™ draft was 1.1× during core spinning. Loom speed was 500 picks per minute at a pick level of 60 picks per inch. Fabric construction was a 1/1 plain weave.

Fabric characteristics are summarized in Table 3. After finishing, this fabric had good weight (137.7 g/m$^2$), fabric stretch (16%), width (65 inches), and low wash shrinkage (1.25%) with no grin-through (a rating of 5). Fabric appearance was flat with a natural look and the hand was soft. Fabric appearance and hand were improved over that for Comparison Example 1B. These results indicate that this fabric can be used to make excellent stretch shirting.

Example 2B

This Example demonstrates a stretch shirting fabric comprising 50D T-400™ core spun yarn. The warp yarn was 80/2 Ne count of ring spun cotton yarn, the weft was a low denier yarn: 38 Ne cotton/50D T-400° in which the T-400™ draft was 1.08× during core spinning. Loom speed was 500 picks per minute at 65 picks per inch. Fabric construction was a 1/1 plain weave.

Fabric characteristics are summarized in Table 3. This sample had light weight (139.7 g/m$^2$), good stretch (18.6%), wider width (64.5 inches) low wash shrinkage (0.5%), and no grin-through (a rating of 5). As a result of these characteristics, a heatset process is not necessary for this fabric. The fabric appearance and hand are also improved relative to heatset fabrics. The fabric can be used to make excellent stretch shirting.

Example 3B

This Example demonstrates a stretch twill bottom weight fabric comprising T-400® core spun yarn. The warp yarn was 20 cc open end cotton yarn; the weft yarn was 27 Ne cotton with 75D T-400™ core spun yarn in which the T-400™ draft was 1.1× during core spinning. The loom speed was 500 picks per minute at 50 picks per inch. Fabric construction was a 3/1 twill.

Fabric characteristics are summarized in Table 3. After finishing, the fabric had good weight (229.8 g/m$^2$), good available fabric stretch (22.2%), good width (55.75 inches), and low wash shrinkage (2.08%) in the weft direction. The fabric looks flat and has an excellent, soft hand. With a grin-through rating of 4, the fabric is acceptable for apparel applications. Its characteristics demonstrate that cotton/polyester bicomponent core spun yarn can be used to produce high performance stretch fabric which does not require special care.

Example 4B

This Example demonstrates a stretch twill fabric comprising T-400® core spun yarn and a blended polyester/rayon yarn in a twill fabric. The warp yarn was 20 Ne 65% polyester/35% rayon ring spun yarn; the weft was 27 Ne cotton with 75D T-400™ core spun yarn in which the T-400® draft was 1.1× during core spinning. Loom speed was 500 picks per minute at 50 picks per inch. Fabric construction was a 2/1 twill.

Fabric characteristics are summarized in Table 3. After finishing, this fabric had reasonable fabric stretch (15.6%), wider width (57.25 inches), and low shrinkage (1.52%). The fabric cover factor in the warp direction was quite large (81%), which caused the fabric to have 15.6% available stretch. This level of available stretch is acceptable for comfortable stretch in some applications.

Example 5B

This Example demonstrates a stretch denim fabric comprising T-400™ core spun yarn. The warp yarn was 7.75 Ne ring spun cotton indigo yarn; the weft yarn was 20 Ne cotton with 150D T-400™ core spun yarn in which the T-400™ draft was 1.1× during core spinning. Fabric construction was a 3/1 twill. The loom speed was 500 picks per minute at 44 picks per inch. After finishing, the fabric was subjected three times to a wash at 63° C. for 45 minutes to simulate the stone washing process for jeans. The wash procedure followed the AATCC Test Method 96-1999, "Dimensional Changes in Commercial Laundering of Woven and Knitted Fabrics Except Wool," Test IIIc. After the three washes, the fabric was dried by the tumble dry method at 60° C. for 30 minutes as specified in the test method.

Fabric characteristics are summarized in Table 3. The fabric had good stretch (19.6%) and wider width (56.5 inches). The fabric also had essentially no shrinkage in the weft direction (0%) after the jean stone wash process.

Example 6B

This Example demonstrates a stretch denim fabric comprising T-400™ core spun yarn which has been subjected to a simulated stone wash process for jeans and then bleached. The fabric of Example 5B was subjected to three washes to simulate the jean stone washing process (described above) and then bleached as described below. The bleaching conditions used for the fabric sample were more severe than those normally used industrially.

The bleaching process was carried out at a 30:1 liquid to fabric ratio. The fabric sample was added to a solution of 200 g/l sodium hypochlorite with 6.3% chloride (Clorox Professional Products Co.) and 0.5 g/l Merpol® HCS (E.I. duPont de Nemours and Co.) as wetting agent detergent adjusted to pH 10.0-11.0 with soda ash at 45° C. The fabric was tumble washed in the bath at 45° C. for 45 minutes. The bath was then drained and cleared thoroughly. The fabric was removed, then added to a fresh solution of 200 g/l sodium hypochlorite with 6.3% chloride and 0.5 g/l Merpol® HCS adjusted to pH 10.0-11.0 with soda ash at 60° C. The fabric was tumble washed in the bath at 60 (C for 45 minutes. The bath was then drained and cleared thoroughly. The fabric was removed and added to a fresh bath of 1.0 g/l antichlorine sodium meta bisulfite (J. T. Baker Co.) at 24° C. The fabric was tumble washed in the bath at 24° C. for 15 minutes, then removed and dried in air.

After the two bleachings, the fabric became totally white. Fabric characteristics for the bleached fabric are summarized in Table 3. The fabric still had good available stretch (22.4%) and low growth (3.00%). The data shows that the fabric withstood not only the jean stone washing process but also the strong bleaching process while maintaining good elasticity and recovery power.

Comparison Example 1B

This Example demonstrates a typical stretch woven fabric comprising a spandex core spun yarn. The warp yarn was 80/2 Ne count of ring spun cotton yarn; the weft yarn was 40 Ne cotton with 40D Lycra® spandex core spun yarn in which the spandex draft was 3.5× during core spinning. This weft yarn is a typical stretch yarn used in stretch woven shirting fabrics. Loom speed was 500 picks per minute at a pick level of 70 picks per inch. Fabric construction was a 1/1 plain weave.

Fabric characteristics are summarized in Table 3. After finishing, the fabric had heavy weight (194.1 g/m$^2$), excessive stretch (63.6%), narrow width (47.2 inch), and high weft wash shrinkage (7.25%) due to this combination of stretch yarns and fabric construction. This fabric would require heat setting in order to reduce the fabric weight and to control shrinkage. This fabric also had a harsh hand and lacked a cottony feel.

Comparison Example 2B

This Example demonstrates a typical stretch woven fabric comprising bare T-400™ filament. The warp yarn was 80/2 Ne count ring spun cotton; the weft yarn was 75D T-400™ with 34 filaments (bare T-400® filament). The T-400™ filament had 28.66% after heat-set crimp contraction. Fabric construction was a 1/1 plain weave.

Fabric characteristics are summarized in Table 3. This fabric sample had lighter weight (117.6 g/m$^2$), good stretch (26.6%), and lower weft direction wash shrinkage (0.25%) than Comparison Example 1B. But Comparison Example 2B had a strong synthetic polyester hand and a grin-through rating of 1, meaning the bicomponent filament is completely exposed on the fabric surface. T-400™ filament can be seen and felt during wear, rendering this fabric unacceptable for apparel applications.

Comparison Example 3B

This example demonstrates a stretch woven twill fabric with 150D T-400® core spun yarn. Fabric construction was a 3/1 twill as in Example 3B but with higher T-400™ content within the weft yarn (46.26% as compared to 28.59% in Example 3B). The warp yarn was 20 Ne count of open end yarn; the weft yarn was 54.7 Ne cotton with 75D T-400® core spun yarn in which the T-400™ draft was 1.1× during core spinning. Loom speed was 500 picks per minute at a pick level of 60 picks per inch.

Fabric characteristics are summarized in Table 3. After finishing, this fabric had good weight (209.1 g/m$^2$), fabric stretch (22%), width (56 inch), and low wash shrinkage (1.25%). However, The T-400™ filament was visible on the back of the fabric, resulting in a grin-through rating of 2. Such fabric is not acceptable for normal apparel application due to the grin-through of the bicomponent filament.

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed and that modifications and other embodiments are intended to be included within the scope of the appended claims.

What is claimed is:

1. A woven stretch fabric having warp and weft yarns and comprising polyester bicomponent filament core spun yarn, wherein a) the bicomponent filament core spun yarn comprises i) a sheath of at least one hard staple fiber;

ii) a core of polyester bicomponent filament comprising poly(trimethylene terephthalate) and at least one

TABLE 3

Data for Fabric Examples.

| Fabric Example # | Warp Yarn | Weft Yarn | Weave Pattern | Fabric on Loom, inches * | Fabric Width on Loom, inches | Finished Fabric Width, inches | Finished Fabric Weight, g/m$^2$ |
|---|---|---|---|---|---|---|---|
| 1B | 80/2's 100% cotton | 32's cotton + 75D T-400 ™ CSY | 1/1 plain | 96 × 60 | 76 | 65 | 137.7 |
| 2B | 80/2's 100% cotton | 38's cotton + 50D T-400 ™ CSY | 1/1 plain | 96 × 65 | 76 | 64.5 | 139.7 |
| 3B | 20's 100% cotton open end yarn | 27's cotton/ 75D T-400 ™ CSY | 3/1 twill | 86 × 50 | 72 | 55.75 | 229.8 |
| 4B | 20's 65% polyester/ 35% Rayon ring spun | 27's cotton + 75D T-400 ™ CSY | 2/1 twill | 102 × 50 | 76 | 57.25 | 222.0 |
| 5B | 7.75' open end cotton Indigo yarn | 20's cotton + 150D T-400 ™ | 3/1 twill | 62 × 44 | 72 | 56.5 | 394.4 |
| 6B | 7.75' open end cotton Indigo yarn | 20's cotton + 150D T-400 ™ | 3/1 twill | 62 × 44 | 72 | 56 | 370.6 |
| Comp. Ex. 1B | 80/2's 100% cotton | 40' cotton/ 400 Lycra ® spandex 3.5X CSY | 1/1 plain | 96 × 70 | 76 | 47.2 | 194.1 |
| Comp. Ex. 2B | 80/2's 100% cotton | Bare 75D T-400 ™ filament | 1/1 plain | 96 × 75 | 76 | 60 | 117.6 |
| Comp. Ex. 3B | 20's 100% cotton open end yarn | 54.7's cotton + 75D T-400 ™ CSY | 3/1 twill | 86 × 60 | 72 | 56 | 209.1 |

| Fabric Example # | Finished Fabric Stretch, % | Finished Fabric Growth % | Finished Fabric Shrinkage, % (warp × weft) | Finished Fabric T-400 ® content, wt % | FCF on loom, % (warp × weft) | Finished Fabric Grin-Through Rating |
|---|---|---|---|---|---|---|
| 1B | 16 | 2.4 | 1.5 × 1.25 | 13.8 | 54 × 46 | 5 |
| 2B | 18.6 | 2.8 | 1.33 × 0.5 | 10.9 | 54 × 44 | 5 |
| 3B | 22.2 | 3.4 | 1.5 × 2.08 | 10.5 | 68 × 40 | 4 |
| 4B | 15.6 | 2.2 | 1.69 × 1.52 | 9.4 | 81 × 40 | 5 |
| 5B | 19.6 | 2.6 | 3.2 × 0 | 11 | 80 × 44 | 5 |
| 6B | 22.4 | 3.0 | 0.58 × 0.2 | 11 | 80 × 44 | 5 |
| Comp. Ex. 1B | 63.6 | 4.2 | 1.3 × 7.25 | 2.5 | 54 × 40 | 5 |
| Comp. Ex. 2B | 26.6 | 1.8 | 0.5 × 0.25 | 32 | 54 × 32 | 1 |
| Comp. Ex. 3B | 22 | 2.29 | 1.25 × 1.25 | 18.9 | 68 × 38 | 2 |

* Fabric on loom values given as (warp EPI × weft PPI). EPI refers to ends per inch. PPI refers to picks per inch.

polymer selected from the group consisting of poly (ethylene terephthalate), poly(trimethylene terephthalate), and poly(tetramethylene terephthalate) or a combination of such members, having an after heat-set crimp contraction value of from about 10% to about 80%; and b) the fabric is substantially free of bicomponent filament grin-through wherein i) the weft yarn comprises staple spun yarn or filament;

ii) the warp yarn comprises polyester bicomponent core spun yarn; and iii) the available fabric stretch in the warp direction is from about 10% to about 35%.

2. The fabric of claim 1, wherein the bicomponent filament comprises poly(ethylene terephthalate) and poly(trimethylene terephthalate).

3. The fabric of claim 1, wherein the bicomponent filament comprises poly(trimethylene terephthalate) and poly(tetramethylene terephthalate).

4. The fabric of claim 1, wherein the bicomponent filament comprises poly(trimethylene terephthalate) and poly(trimethylene terephthalate).

5. The fabric of claim 1 wherein the bicomponent filament has an after heat-set crimp contraction value of from about 35% to about 80%.

6. The fabric of claim 1, wherein the fabric is selected from the group consisting of twill, plain, satin, and weft rib construction.

7. A garment comprising the fabric of claim 1.

8. The fabric of claim 1 wherein the bicomponent filament comprises poly(ethylene terephthalate) and poly(trimethylene terephthalate).

9. The fabric of claim 1, wherein the bicomponent filament comprises poly(trimethylene terephthalate) and poly(tetramethylene terephthalate).

10. The fabric of claim 1 wherein the bicomponent filament comprises poly(trimethylene terephthalate) and poly(trimethylene terephthalate).

* * * * *